US006165111A

United States Patent [19]

Walker

[11] Patent Number: 6,165,111

[45] Date of Patent: Dec. 26, 2000

[54] THERAPEUTIC EXERCISE APPARATUS

[76] Inventor: Harriett Walker, 1718 Ginny Dr., Macon, Ga. 31210

[21] Appl. No.: 09/244,714

[22] Filed: Feb. 4, 1999

Related U.S. Application Data

[60] Provisional application No. 60/073,821, Feb. 5, 1998.

[51] Int. Cl.[7] ..... A03B 21/02

[52] U.S. Cl. ..... 482/127; 482/904; 482/121

[58] Field of Search ..... 482/121, 124, 482/127, 148, 129, 118, 114, 905, 906

[56] References Cited

U.S. PATENT DOCUMENTS

D. 199,984 1/1965 Mitchell .

2,782,033 2/1957 Ugartechea ..... 482/905

3,365,194 1/1968 Strickland ..... 482/124

5,518,479 5/1996 Young et al. ..... 482/121

*Primary Examiner*—Jerome W. Donnelly

*Attorney, Agent, or Firm*—Gardner & Groff, P.C.

[57] ABSTRACT

A therapeutic exercise apparatus for use by a patient comprises a base and a tubular post pivotally mounted at a lower end thereof to the base for pivotal, back and forth movement about a pivot axis. Springs are used to urge the tubular post toward a substantially upright position. A handle is mounted distal from the lower end. The tubular post and the springs are adapted to provide only nominal (light) resistence to the tubular post pivoting about the pivot axis to allow the therapeutic exercise apparatus to be used by weak patients, such as accident victims, to regain use of a limb.

4 Claims, 3 Drawing Sheets

THERAPEUTIC EXERCISE APPARATUS

CROSS REFERENCE TO RELATED APPLICATION

The present non-provisional patent application is a continuation-in-part of U.S. Provisional Application Ser. No. 60/073,821, filed on Feb. 5, 1998.

FIELD OF THE INVENTION

The present invention relates generally to medical devices and in particular relates to a therapeutic exercise apparatus.

BACKGROUND OF THE INVENTION

For many medical patients, it is an important part of their therapy and recovery that they exercise. In particular, it can be important in many situations to extend and retract one's arm in order to regain use of the arm. For example, it commonly occurs that victims of cerebrovascular accidents experience flexor synergy. Moderate exercise can go a long way to help such a patient recover.

Unfortunately, typical known exercise equipment is primarily designed for use by persons who are already reasonably fit. Indeed, most exercise equipment is designed to allow a person who is reasonably fit to increase the person's strength or conditioning. In this regard, typical known exercise equipment usually have a moderately high resistance to movement (in order to build muscle tone or muscle mass). Unfortunately, for many medical patients, such moderately high resistence to movement presents an absolute barrier to the use of the equipment because at the moment the patient lacks the strength to move the equipment.

Accordingly, it can be seen that a need yet remains for an therapeutic exercise apparatus which can be used by medical patients and which presents very little resistence to movement. It is to the provision of such a therapeutic exercise apparatus that the present invention is primarily directed.

SUMMARY OF THE INVENTION

Briefly described, in a preferred form the present invention comprises a therapeutic exercise apparatus for use by a patient. The therapeutic exercise apparatus includes a base and a tubular post pivotally mounted at a lower end thereof to the base for pivotal, back and forth movement about a pivot axis. The tubular post has a handle distal from the lower end. Further, the tubular post is mounted to the base in such a manner that there is only very light resistence to the tubular post pivoting about the pivot axis.

Preferably, the tubular post is biased by spring means toward a substantially upright position. Also preferably, the base and the tubular post are each made of plastic. Further, preferable the handle comprises a central upright portion and two additional upright portions straddling the central upright portion.

A therapeutic exercise apparatus according to the invention has numerous advantages. It can be used advantageously to reduce flexor synergy found in patients following cerebrovascular accidents. The therapeutic exercise apparatus helps the patient to regain lost freedom of movement. In this regard, the very low resistence to pivotal movement of the apparatus enables such patients to use the apparatus, in contrast to known exercise equipment which is intended primarily for persons who are already reasonably fit.

Accordingly, it is a primary object of the present invention to provide a therapeutic exercise apparatus which is simple in construction, durable in use, and economical to manufacture.

It is another object of the present invention to provide a therapeutic exercise apparatus which can be used to reduce flexor synergy found in patients following cerebrovascular accidents.

It is another object of the present invention to provide a therapeutic exercise apparatus to allow horizontal adduction and abduction.

These and other objects, features, and advantages of the present invention will become more apparent upon reading the following specification in conjunction with the accompanying drawing figures.

DETAILED DESCRIPTION OF THE PREFERRED EMBODIMENT

Figure 1:
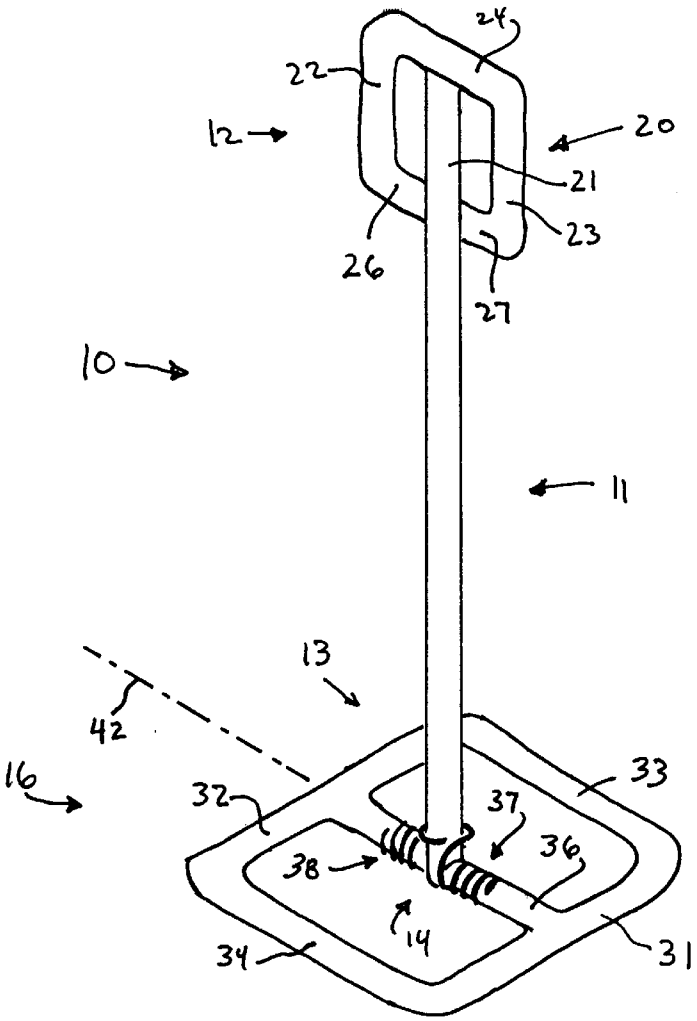
FIG. 1 is a perspective illustration of a therapeutic exercise apparatus according to a preferred form of the invention.

Referring now in detail to the drawing figures, wherein like reference numerals represent like parts throughout the several views, FIG. 1 shows a therapeutic exercise apparatus 10 according to a preferred form of the invention. The therapeutic exercise apparatus 10 includes an upright tubular post 11 having a handle end 12 and a lower end 13. At the lower end 13 of the upright tubular post 11, the upright tubular post 11 is pivotally connected at a pivotal connection 14 to a base 16. The pivotal connection 14 will be explained in more detail in connection with drawing FIG. 2.

The handle end 12 of the upright tubular post 11 includes a handle generally indicated at 20. The handle 20 includes a central handle grip 21 and two side handle grips 22 and 23. An upper connector portion or beam 24 connects the top of the center handle grip 21 and the side handle grips 22 and 23. Similarly, lower connectors 26 and 27 connect the side handle grips 22 and 23 with the upright tubular post 11 at the lower ends of the side handle grips.

At the lower end 13 of the upright tubular post 11, the base 16 is pivotally connected, as previously mentioned. The base includes side portions 31 and 32 and end portions 33 and 34 extending and connecting therebetween. A pivot axle 36 extends from one side 31 to the opposite side 32 half way between the end portions 33 and 34. Springs 36 and 37 help to provide a counter-balance biasing force, as will be described in more detail below.

Figure 2:
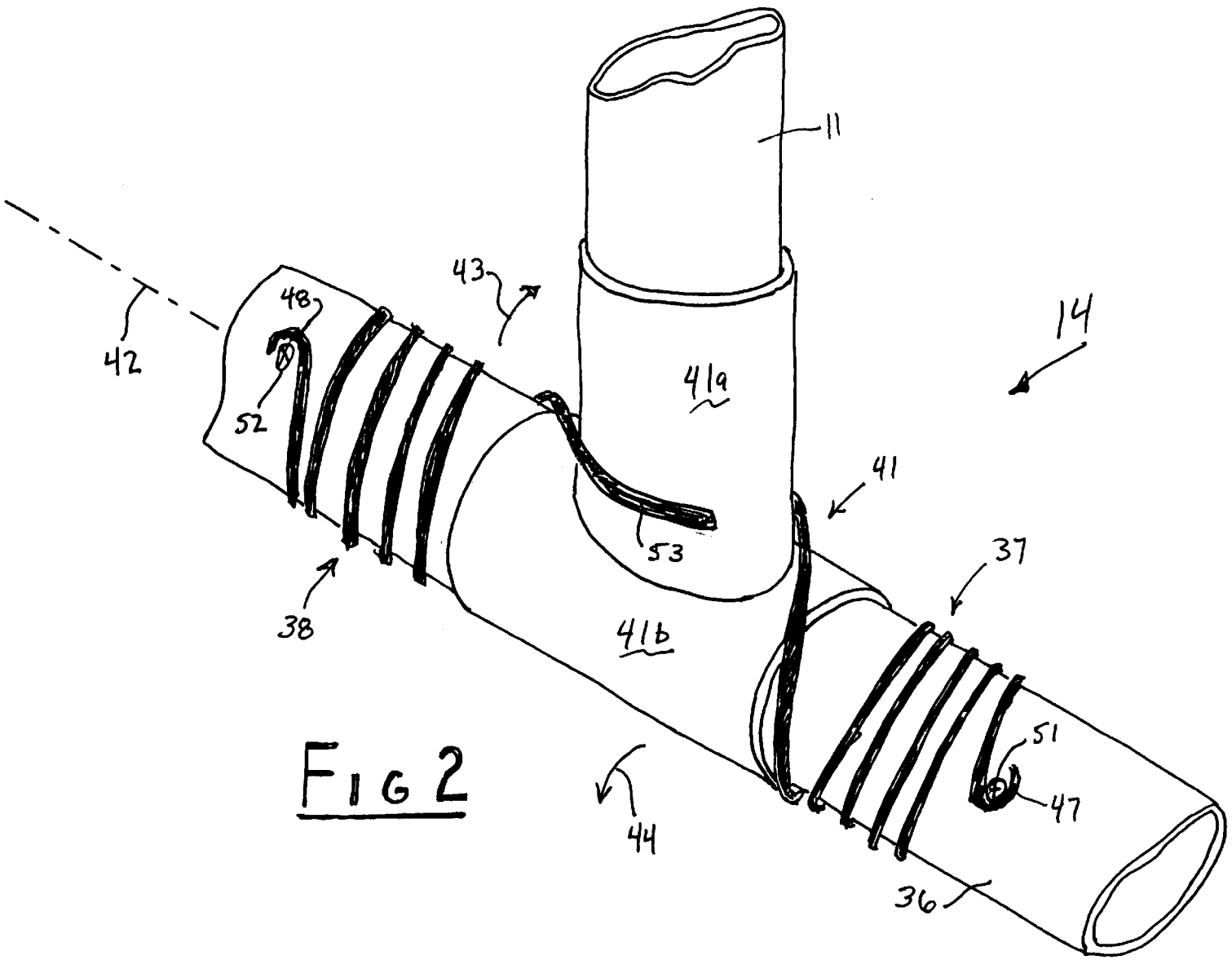
FIG. 2 is a perspective illustration of a portion of the therapeutic exercise apparatus of FIG. 1, shown in greater detail.

Referring now in detail to FIG. 2, the pivotal connection 14 will be considered in greater detail. The upright tubular post 11 is received in a T-shaped collar 41 which provides a pivotal connection between the pivot axle 36 and the upright tubular post 11. The T-shaped collar 41 has an upper section 41*a* and a lower section 41*b*. The collar section 41*b* is rigidly secured to the upright tubular post 11 and is pivotally received over the pivot axle 36 to allow the upright tubular post 11 to pivot about pivot axle 42. In this way, the upright tubular post 11 can be pivoted in the direction of direction arrow 43 or in the direction of direction arrow 44. The springs 36 and 37 are each secured at a hook-shaped small end thereof, such as 47, 48, which are held in place by retention fasteners 51 and 52. The opposite ends of the springs are larger hook-shaped portions, such as 53, for receiving part of the upright portion 41*a* of the T-shaped collar 41. In this way, the first spring 37 provides a biasing force in the direction of direction arrow 44, while the second spring 37 provides a substantially equal biasing force in the opposite direction, that is, in the direction of direction arrow 43. In this way, the biasing forces exerted by the two springs are equal when the springs are in their equilibrium position with the tubular post in its substantially upright configuration. In this way, from this neutral configuration, very little resistence is presented to the user of the therapeutic exercise apparatus, while still providing some slight force to return the upright tubular post to its upright position as shown in FIG. 1.

Figure 3:
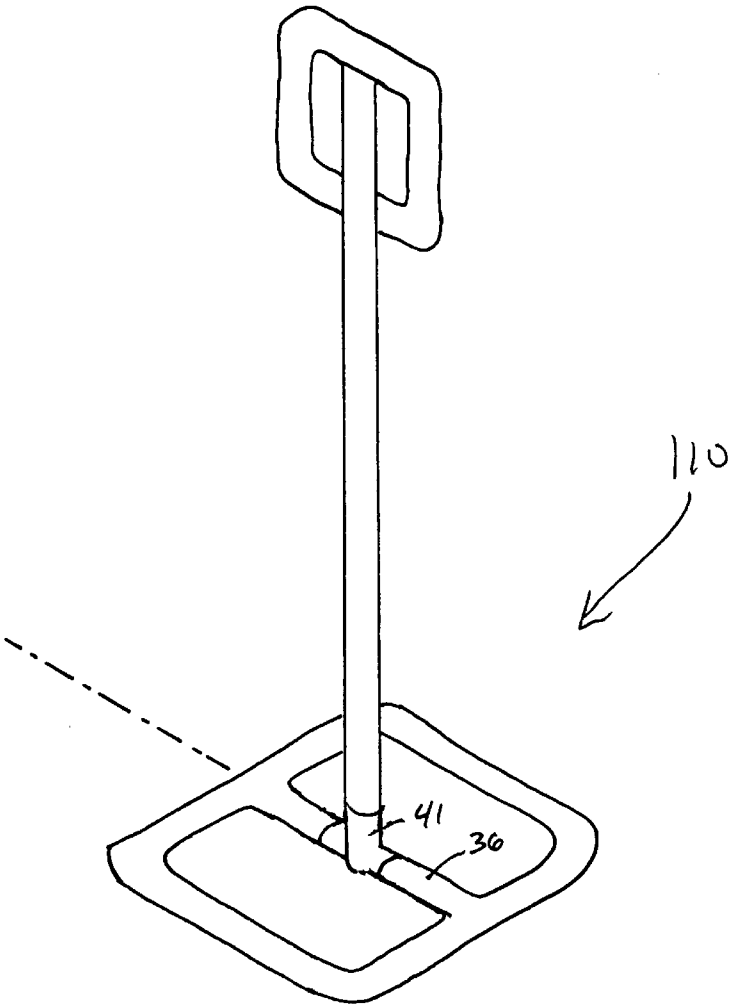
FIG. 3 is a perspective illustration of a therapeutic exercise apparatus according to a modified form of the invention.

FIG. 3 shows an alternate embodiment of a therapeutic exercise apparatus 110 which is substantially identical to the therapeutic exercise apparatus 10 of FIG. 1, with the exception that the biasing springs have been deleted in favor of a slight friction or interference fit between the T-shaped collar 41 and the pivot axle 36.

The therapeutic exercise apparatus according to the present invention can be constructed according to several techniques. For example, in the prototype apparatus constructed and tested, the individual components are made of PVC. However, other materials could be used, including other plastics or metals (such as aluminum, aluminum alloys, or steel). What is important is that a base is provided for allowing pivotal motion of the upright post with the handle, which at the same time providing very light resistence to movement in order to allow rehabilitation patients to use the therapeutic exercise apparatus.

The innovative therapeutic exercise apparatus according to the present invention can be used to reduce flexor synergy seen in patients following cerebrovascular accidents. Several neurodevelopmental theorists have stated that the strongest component of the flexion synergy is elbow flexion. The therapeutic exercise apparatus is a purposeful piece of equipment that allows the elbow to be extended, thereby lengthening the triceps and reducing the flexion pattern. When the patient pulls back, the biceps contract allowing active elbow flexion.

The therapeutic exercise apparatus can also be positioned to allow horizontal adduction and horizontal abduction. Horizontal adduction can be completed by allowing the patient to pull the therapeutic exercise apparatus in towards the body crossing over the chest. Horizontal abduction can be completed by pushing the therapeutic exercise apparatus away from the body until the arm is out to the side.

The therapeutic exercise apparatus allows patients to work through flexor synergy encouraging correct movement patterns with muscle re-education. Initially, the therapeutic exercise apparatus configuration of FIG. 3 can be used with new therapy patients to allow exercise with the barest amount of resistance. Thereafter, springs can be attached (see FIG. 1 and FIG. 2) to upgrade the amount of resistance creating a progressive resistive exercise program. These movements are used regularly to complete activities of daily living such as feeding, grooming, hygiene, dressing and bathing.

While the invention has been disclosed in preferred forms, it will be apparent to those skilled in the art that many modifications, additions, and deletions can be made therein without departing from the spirit and scope of the invention as set forth in the following claims.

What is claimed is:

1. A therapeutic exercise apparatus for use by a patient comprising:

a base having a horizontally positionable member;

a post pivotally mounted at a lower end thereof to said base for pivotal, back and forth movement about a pivot axis, said post having a handle distal from said lover end; and first and second-springs attached to said post for biasing said post toward a substantially upright position, wherein at least a portion of each of said first and second springs wraps around at least a portion of said horizontally positionable member and wherein said post and said are configured and adapted to provide only resistance to pivotal motion of said post about said pivot axis, with said first spring biasing said post in one direction and said second spring biasing said post in an opposite direction.

2. A therapeutic exercise apparatus as claimed in claim 1 wherein said base comprises at least one tubular member.

3. A therapeutic exercise apparatus as claimed in claim 1 wherein said handle comprises a central upright portion and two additional upright portions straddling said central portion.

4. A therapeutic exercise apparatus as claimed in claim 1 wherein said first and second springs are selected to be of similar strength.

* * * * *